United States Patent [19]

Pavese

[11] 4,059,964

[45] Nov. 29, 1977

[54] SHEETING INSTALLATION SYSTEM

[76] Inventor: John R. Pavese, 761 Cathy Ann Court, Paramus, N.J. 07652

[21] Appl. No.: 720,138

[22] Filed: Sept. 3, 1976

Related U.S. Application Data

[63] Continuation-in-part of Ser. No. 566,079, April 8, 1975, abandoned.

[51] Int. Cl.[2] ..... E21D 5/12

[52] U.S. Cl. ..... 61/41 A; 52/293

[58] Field of Search ..... 61/41, 106, 105, 39, 61/49, 35; 52/619, 625, 293

[56] References Cited

U.S. PATENT DOCUMENTS

| | | | |
|---|---|---|---|
| 3,584,465 | 6/1971 | Holl | 61/41 A |
| 3,606,757 | 9/1971 | DeWeese et al. | 61/41 A |
| 3,916,629 | 11/1975 | Thompson | 61/41 A |
| 4,002,035 | 1/1977 | Wright | 61/41 A |

*Primary Examiner*—Jacob Shapiro

*Attorney, Agent, or Firm*—Robert A. Maikis

[57] ABSTRACT

A sheeting installation system is provided for installing trench wall support sheeting during the excavation of trenches and the like. A rectangular frame is formed by a pair of sheeting support wall members which are secured to a pair of spreader members disposed at the opposite ends of the wall members. Each wall member has a modular construction and several vertically-disposed sheeting support slots which extend through the member from top to bottom. The slots are overlapped and each slot slidably receives a sheeting section which is driven into the earth so that it projects a distance beneath the bottom of the frame but still has a portion of its length remaining in the slot to provide cantilever support for the section against the force exerted by the walls of the trench. Since the slots in each wall member are overlapped, the sheeting sections will be driven into the earth in overlapping relationship. Spreader members of different lengths are utilized for trenches of different widths and trench wall side cutters may be provided on the frame. Locking means keep the sheeting sections retracted into the slots when the frame is moved.

9 Claims, 11 Drawing Figures

SHEETING INSTALLATION SYSTEM

RELATED APPLICATIONS

This is a continuation-in-part of application Ser. No. 566,079, filed Apr. 8, 1975, now abandoned.

BACKGROUND OF THE INVENTION

1. Field of the Invention

This invention relates generally to safety devices for use in the construction industry and more particularly to a sheeting installation system and frame which are utilized to install trench wall support sheeting sections in overlappping relationship during trench excavations and the like to prevent the sides of the trench from collapsing.

2. Description of the Prior Art

A serious safety problem exists during the underground installation of sewer and water pipes and the like where substantially narrow, but deep, trenches must be excavated. If a back hoe or similar piece of mechanical excavation equipment is utilized, the sides or walls of the trench are substantially vertical and are sharply defined, thereby increasing the possibility that the sides of the trench may collapse to cause death or injury to workmen working at the bottom of the trench. Although so-called "safety drag boxes" have been developed which are lowered into the trench after excavation to prevent the walls of the trench from collapsing, the condition of the soil in the area being excavated very often precludes the use of such devices. For example, in areas where the ground is very wet or has a very high sand content, the removal of the drag box by lifting it out of the trench or dragging it along the trench to the next working location could cause the trench walls to collapse or the ground at the bottom of the trench to shift and thereby disturb the pipe being installed from its prescribed location. In situations of this type, it is customary for the engineering specifications for the job to provide for the use of trench wall support sheeting by the contractor. The support sheeting usually consists of sections of steel sheets or sections formed of wood planking which are driven into the ground along the proposed side lines of the trench. Although wood sheeting sections are still used in some areas, it has become customary to use steel plate sheeting sections because of the greater strength and safety offered. The sheeting sections may be completely flat or may be corrugated to increase their lateral or bending strength.

At the present time, the installation of trench wall sheeting is a laborious, time-consuming and expensive operation. The first step usually involves the fabrication of a rectangular, steel support assembly which has a width corresponding to the width of the proposed trench. The four members of the assembly are usually cut to the required length and assembled at the job site from narrow widths of steel channels, beams or angles. When the first assembly is completed, it is placed on the ground in alignment with the proposed side walls of the trench and the steel sheeting sections are placed along the outside edge or periphery of the frame along the trench lines. The sheeting sections are then driven down into the earth for a specified distance and the earth between the sheeting is then excavated. At this time, a second steel support assembly is fabricated and is lowered into the trench where it is wedged into position between the sheeting sections on opposite sides of the trench to resist the lateral forces exerted by the sidewalls of the trench. The sheeting is then driven down a further distance and another rectangular support assembly is installed. This process is repeated until the bottom of the trench is reached. The number of support assemblies utilized and the number of steps involved will, of course, depend upon the depth of the trench. After the pipe or utility main is laid on the floor of the trench, the sheeting is withdrawn in increments or steps and the support assemblies are successively removed as the earth is filled back into the trench.

Although support assemblies of the foregoing type have been developed where the assembly members are hinged together at the corners to permit the assemblies to be collapsed and transported from a completed section of the trench to the next section to be excavated, the time and labor costs involved in fabricating the assemblies, installing the various assemblies at the different depths in the trench, removing the individual assemblies and transporting them to the next section of trench are very substantial and greatly add to the overall cost of the job. Sheeting installation systems have also been developed which utilize sheeting support frames in which relatively thick wood or metal planks having a small surface area are supported by vertically-disposed guide members or channels in the frame while they are being driven into the earth. These systems are not suited for the installation of the newer types of sheeting in which the sheeting sections comprise relatively thin sheets, either corrugated or uncorrugated, having a large surface area because the guide members or channels provide insufficient lateral support to prevent bending of the sheets about a vertical axis which is perpendicular to the plane of the earth's surface. Corrugated sheeting having vertically-disposed corrugations has sufficient structural strength to prevent bending about a horizontal axis which is parallel to the plane of the earth's surface but has a much lower strength with respect to bending about the aforementioned vertical axis. Because of the tendency of the newer types of sheeting to bend about the vertical axis, it is important that the sheeting sections be overlapped when they are installed so that any vertical axis bending caused by the laterally-applied force of the trench walls will not separate the sheeting sections and permit earth and sand to enter the trench. Apart from the sheeting section bending problem, the use of overlapped sheeting sections is important when work is done in areas having a high sand content or very wet earth since even a small separation between adjacent sheeting sections will permit a large volume of sand or earth to enter the excavated trench. The construction of the guide members of known types of sheeting installation frames actually prevents the sheeting sections from being overlapped as they are installed. Furthermore, the existing types of installation frames do not provide for enclosure of the guide members to prevent injury to workmen in the trench as the sheeting sections are being driven into position.

Accordingly, a need exists for equipment which will facilitate the installation of support sheeting by eliminating job site fabrication of support assemblies and the time-consuming steps of installing and removing the separate support assemblies for each length of trench being excavated. Additionally, a substantial need exists for a sheeting installation frame which will permit the installation of the newer types of sheeting in overlapped relationship and which offers a closed guide slot construction for worker safety. The sheeting installation frame should also be mechanically rugged and be easily transported from one section of the trench to the next. The equipment should also be adjustable to handle trenches of different widths and should be able to accomodate standard or special sheeting sections. Finally, means should be provided to permit the sheeting sections to be moved with the installation equipment when the equipment is moved along the trench.

SUMMARY OF THE INVENTION

It is an object of this invention to provide a sheeting installation system and a frame therefor having a novel overlapped sheeting support slot construction which provides cantilever support for the sections of sheeting being installed and permits the sheeting sections to be overlapped during installation, to thereby eliminate the fabrication and installation of a number of individual sheeting support assemblies.

It is a further object of this invention to provide a sheeting installation frame which is especially suited for use with the aforementioned newer types of sheeting and which permits the installation of such sheeting in overlapped relationship.

It is a still further object of this invention to provide a sheeting installation frame having a novel closed sheeting support slot construction for worker safety and which can accomodate both the newer and older types of sheeting.

It is another object of this invention to provide a sheeting installation frame which has vertically-disposed front cutting edges to aid in excavating the side walls of the trench as the frame is dragged from one section of the trench to the next.

It is an additional object of this invention to provide a sheeting installation frame having overlapped sheeting support slots in a unique modular construction which permits the frame to be manufactured in various lengths with a minimum number of standard-sized components.

Briefly, the sheeting installation system of the invention has a sheeting installation frame which comprises a pair of sheeting support wall members and a pair of spreader members which are removably connected between the wall members adjacent opposite ends thereof. Each of the wall members has substantially vertically-disposed sheeting support slots extending therethrough for slidably supporting sheeting sections therein with cantilever support. The support slots are located along the length of the wall member in overlapping relationship so that the sheeting sections in the slots are overlapped. Spreader members of different lengths may be employed to permit the installation frame to be used in trenches of different widths. Each of the wall members may have one end thereof tapered to provide a substantially vertically-disposed cutting edge, so that the pair of cutting edges so formed is adapted to function as side cutters to widen the trench as the frame is dragged therealong. Means are also provided to lock the sheeting sections in retracted positions within the support slots to permit the installation frame to be moved with the sheeting sections in the slots.

The sheeting support slots in the wall members are each located in a unique modular wall section, so that the number of sheeting sections handled by the installation frame may be increased merely by adding additional modular sections to lengthen the walls. The modular sections are defined by a series of substantially vertically-disposed and spaced apart end plates having laterally-extending edge portions. The end plates between abutting modular sections are stepped plates having longitudinally-extending central portions joining the edge portions thereof to separate the support slots of the abutting modular sections, so that the support slots of abutting modular sections are disposed on opposite sides of the end plate central portions in overlapping relationship. First and second spaced apart rows of substantially horizontally-disposed support beams interconnect the corresponding edge portions of the end plates defining the modular section and cover plates are mounted on opposite sides of each of the rows of support beams. The cover plates extend between the end plates, so that the sheeting support slot in each modular section has closed walls defined by the inwardly facing cover plates in the space between said rows of support beams and the central and edge portions of the end plates defining the modular section.

The nature of the invention and other objects and additional advantages thereof will be more readily understood by those skilled in the art after consideration of the following detailed description taken in conjunction with the accompanying drawings. The terms "sheeting" and "sheeting sections" as used hereinafter in the specification and claims shall be deemed to refer to relatively thin sheets, either corrugated or uncorrugated, having a large surface area and shall not refer to wood or metal planks which are relatively thick and have a small surface area.

DESCRIPTION OF THE PREFERRED EMBODIMENT OF THE INVENTION

Figure 1:
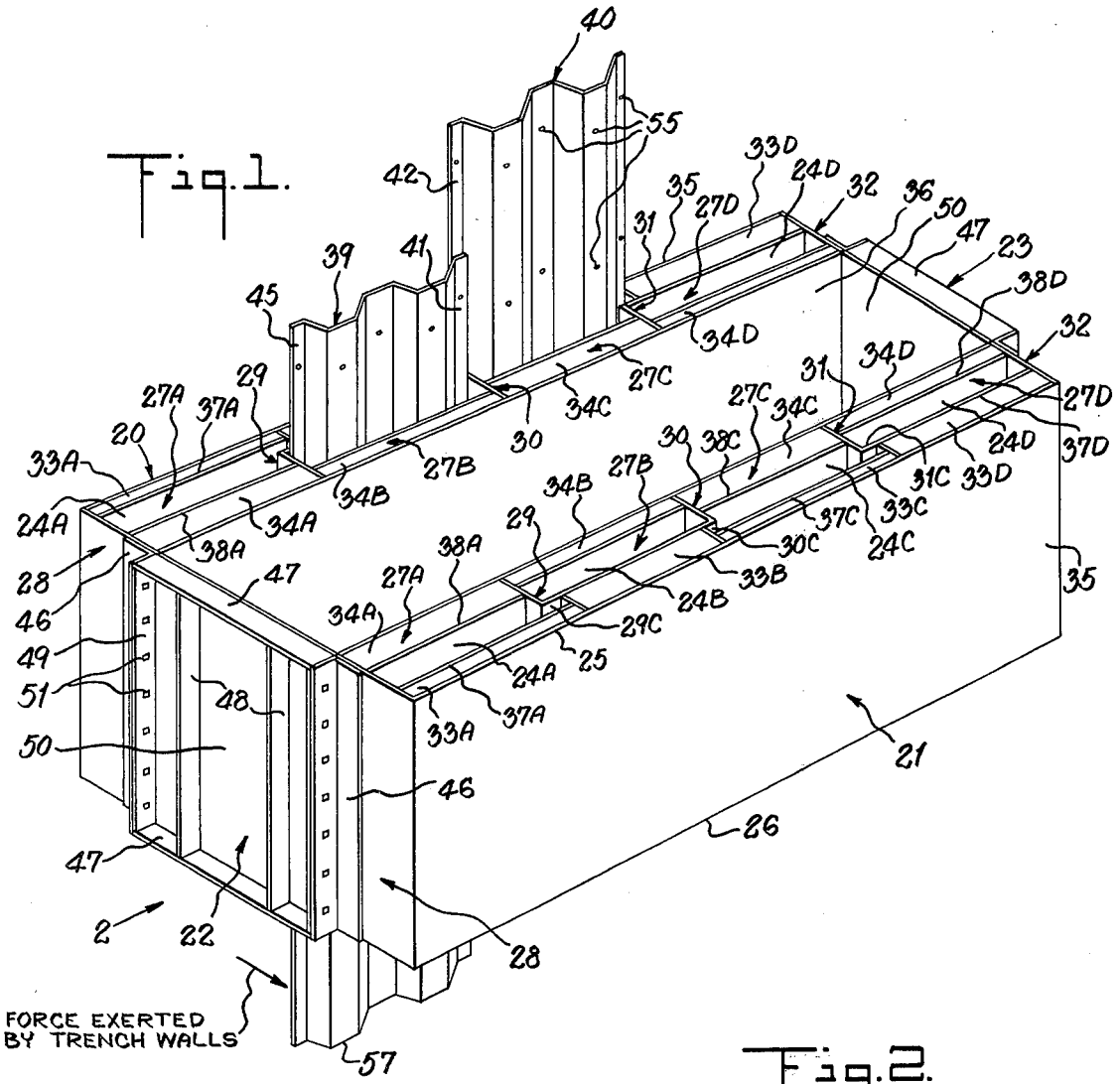
FIG. 1 is a perspective view of a sheeting installation frame constructed in accordance with the teachings of the present invention and having sheeting sections disposed in two of the sheeting support slots therein.
Figure 2:
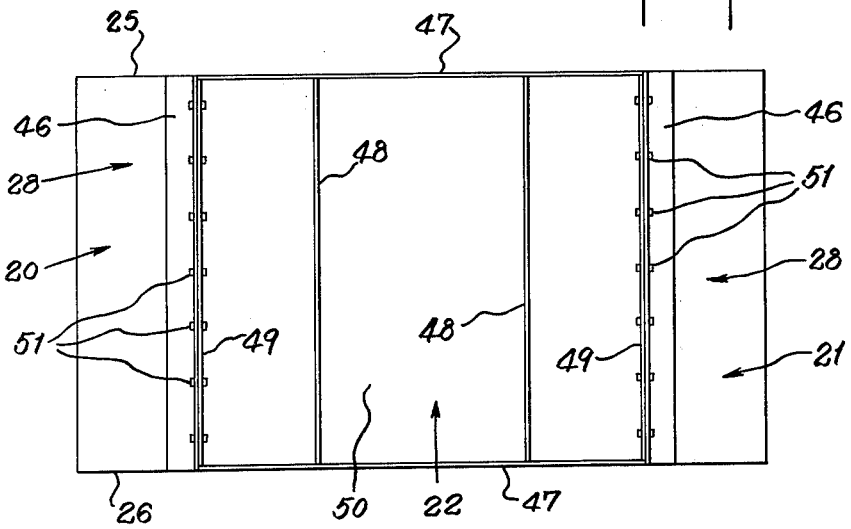
FIG. 2 is a front elevational view of the sheeting installation frame looking in the direction of arrow 2 in FIG. 1 of the drawings.

Referring now to FIGS. 1 and 2 of the drawings, there is shown a sheeting installation frame constructed in accordance with the teachings of the present invention comprising a first sheeting support wall member 20, a second sheeting support wall member 21, a front spreader member 22 and a rear spreader member 23. Each of the wall members 20 and 21 is formed with four sheeting support slots 24A, 24B, 24C and 24D which are substantially vertically-disposed and which pass through each wall member from the top 25 to the bottom 26 thereof. As seen in FIGS. 1, 3, 4 and 5 of the drawings, each sheeting support wall member is formed by four modular sections 27A, 27B, 27C and 27D which are defined by a series of substantially vertically-disposed, spaced apart end plates 28, 29, 30, 31 and 32. The end plates have laterally-extending edge portions 28A through 32A and 28B through 32B which are substantially perpendicular to the plane of the wall member. Those end plates 29, 30 and 31 which are between abutting modular sections are "stepped" plates and have longitudinally-extending central portions 29C, 30C and 31C which join the edge portions thereof. Since the central portions 29C, 30C and 31C of the end plates extend longitudinally of the wall member, they are substantially parallel to the plane of the wall member. The end plates 28 and 32 which form the ends of each wall member have laterally-extending central portions and are substantially planar plates.

Figure 3:
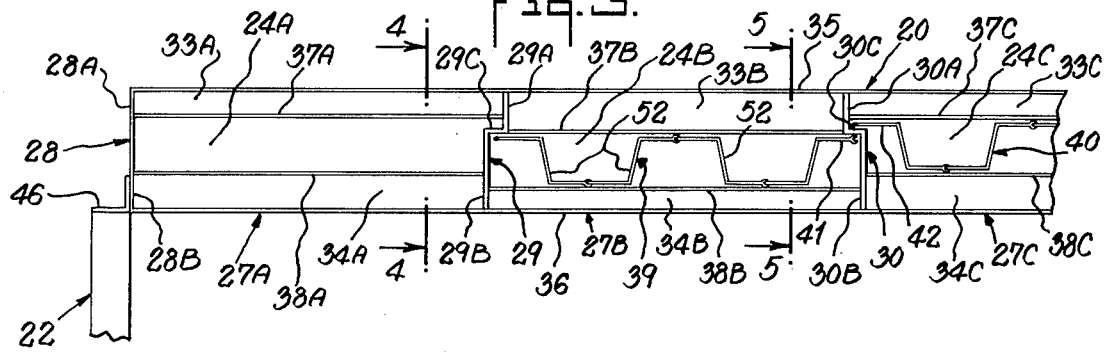
FIG. 3 is a fragmentary plan view of one of the sheeting support wall members of the frame showing a preferred type of support sheeting disposed in the sheeting support slots.
Figure 4:
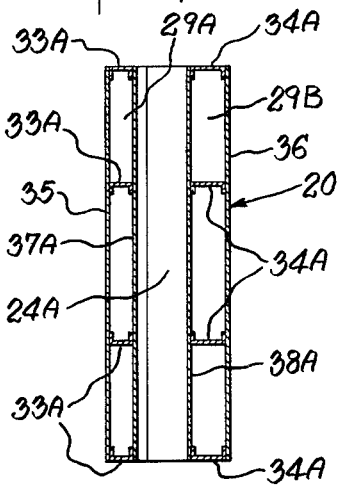
FIG. 4 is a full vertical sectional view of the sheeting support wall member of FIG. 3 taken along the line 4—4 in FIG. 3.
Figure 5:
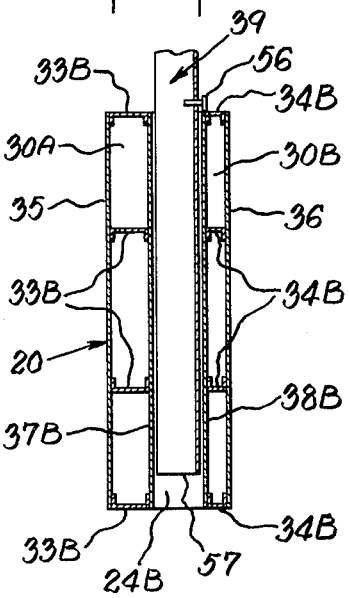
FIG. 5 is a full vertical sectional view of the sheeting support wall member of FIG. 3 taken along the line 5—5 in FIG. 3.

Each of the modular sections 27A through 27D has first and second spaced apart rows 33 and 34 of substantially horizontally-disposed support beams interconnecting the corresponding edge portions of the end plates defining the modular section. As seen in FIGS. 3 and 4 of the drawings, a first row of four vertically-aligned support beams 33A is connected between the edge portions 28A and 29A of the end plates defining modular section 27A and a second row of four vertically-aligned support beams 34A is connected between the edge portions 28B and 29B of the same end plates. In modular section 27B, a row 33B of support beams interconnects the edge portions 29A and 30A of the end plates defining that section and a row 34B of support beams interconnects the end plate edge portions 29B and 30B as seen in FIG. 5 of the drawings. In a similar fashion, support beams 33C and 34C are connected between the end plates 30 and 31 which define modular section 27C and support beams 33D and 34D are connected between the end plates 31 and 32 which define modular section 27D. The ends of the support beams are secured to the end plates by suitable means, such as welding, for example, so that a rigid modular frame is formed for each wall member. The outer flanges of the support beams 33 and 34 are made flush with the side edges of the end plates 28 through 32 and a rectangular cover plate 35 is secured by means, such as welding, for example, to the outwardly-facing flanges of support beams 33 and the side edges of the end plates. A similar cover plate 36 is secured to the outwardly-facing flanges of support beams 34 and to the side edges of the end plates 28 through 32 to create a wall member of great structural strength and modular construction.

The sheeting support slots 24 in each wall member are formed by welding cover plates 37 and 38 to the inwardly-facing flanges of the support beams 33 and 34 and to the end plates defining the modular sections. As seen in FIGS. 1, 3 and 4, a rectangular cover plate 37A is welded to the inwardly-facing flanges of support beams 33A and the edge portions 28A and 29A of the end plates defining modular section 27A while a similar cover plate 38A is welded to the inwardly-facing flanges of support beams 34A and the edge portions 28B and 29B of the end plates for that modular section. The sheeting support slot 24A which is produced by this arrangement is substantially vertically-disposed and has closed walls defined by the inwardly-facing cover plates 37A and 38A in the space between the rows 33A and 34A of support beams and by the central portion and edge portions of the end plates 28 and 29. The closed wall slot construction insures that a workman in the space between the wall members 20 and 21 is separated from a sheeting section in the slot by the cover plates 38A and 36 so that the workman could not injure himself by accidentally inserting his fingers or clothing in the space between the sheeting section and the wall member as the sheeting section is driven into the earth. As seen in FIGS. 1, 3 and 5, the support slot 24B of modular section 27B is formed in a similar manner by cover plate 37B which is welded to the inwardly-facing flanges of support beams 33B and to the end plates 29 and 30 and by cover plate 38B which is welded to the inwardly-facing flanges of support beams 34B and to the end plates 29 and 30. The support slots 24C and 24D of the remaining modular sections are similarly formed by the cover plates 37C, 38C, 37D and 38D.

It will be noted that the longitudinally-extending central portions of the stepped end plates 29, 30 and 31 which are between abutting modular sections separate and define the support slots in those modular sections so that the support slots of the abutting modular sections are disposed on opposite sides of the end plate central portions in overlapping relationship. The central portion 29C of end plate 29 which is between modular sections 27A and 27B forms a part of the closed walls of both support slot 24A and support slots 24B, so that these support slots lie on opposite sides of that end plate central portion and are overlapped. Similarly, end plate central portion 30C separates and defines support slots 24B and 24C and end plate central portion 31C separates and defines slots 24C and 24D. As seen in FIGS. 1, 3, 4 and 5 of the drawings, the support beams 33 and 34 of abutting modular sections are fabricated in different widths to facilitate the offsetting of the support slots on opposite sides of the end plate central portions. For example, support beams 33B of modular section 27B are wider than support beams 33A of modular section 27A and support beams 34B are narrower than support beams 34A in these sections. It will also be noted that successive stepped end plates face in opposite directions so that adjoining support slots are shifted laterally or "staggered." For example, in three abutting modular sections such as sections 27A, 27B and 27C, the stepped end plates 29 and 30 which define the center section 27B face in opposite directions, so that the support slot 24B of the center modular section is disposed on one side of the end plate central portions 29C and 30C and the support slots 24A and 24C of the abutting modular sections are disposed on the other side of these end plate central portions. By virtue of this arrangement, each of the wall members 20 and 21 may be provided with a series of sheeting support slots which are located along the length of the wall member in overlapping relationship. The unique modular construction of the invention permits wall members of any desired length and sheeting section capacity to be easily fabricated from a small number of standardized structural parts.

Figure 6:
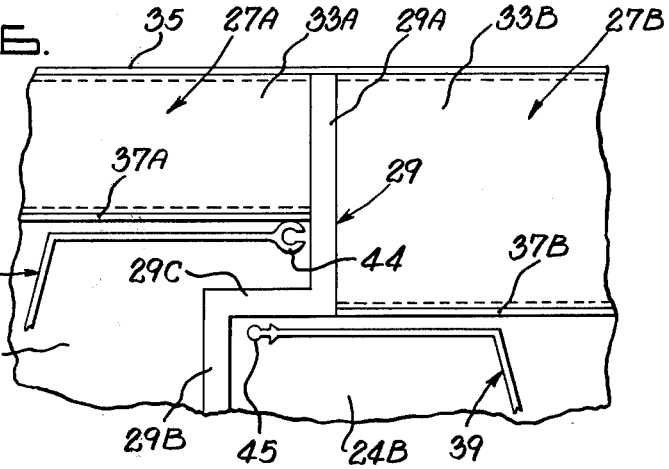
FIG. 6 is a fragmentary plan view on an enlarged scale of the sheeting support wall member of FIG. 3 showing the overlapping relationship of adjacent sheeting support slots with sections of sheeting in the slots.

Each of the support slots of the wall members is adapted to slidably receive a sheeting section. As seen in FIGS. 1 and 3, a sheeting section, indicated generally as 39, is disposed in slot 24B of wall member 20 and a similar sheeting section 40 is disposed in slot 24C. These sheeting sections are of the corrugated type and have substantially vertically-disposed corrugations formed therein to increase the strength of the sections with respect to bending moments about the horizontal axis. When the sheeting sections are in place in the support slots and project into an excavated trench as explained hereinafter, a lateral force is exerted on the projecting portion of the sheeting section by the trench wall which tends to bend these sheets about the horizontal bending axis. Since the corrugations are vertically-disposed, the sheeting sections will resist this bending about the horizontal axis but will be structurally weaker with respect to bending about a vertical axis. Because of the closed wall slot construction of the invention, however, the upper portion of each sheeting section is supported between the cover plates 37 and 38 so that it is difficult to bend the sections about the vertical axis when they are disposed in the support slots. In practice, it is customary to overlap sheeting sections so that any vertical axis bending or any shifting of the sections will not produce gaps between the sections which will admit earth or sand into the excavated trench. For example, the vertical edge portion 41 of sheeting section 39 should overlap the edge portion 42 of sheeting section 40. As seen in FIG. 3, the edge portions 41 and 42 of these sheeting sections are automatically overlapped since they lie in different support slots on opposite sides of the end plate central portion 30C. FIG. 6 of the drawings shows a sheeting section 43 disposed in support slot 24A. This sheeting section has a vertical edge portion 44 which is disposed on one side of the stepped plate central portion 29C. The other vertical edge portion 45 of sheeting section 39 is disposed on the other side of stepped plate central portion 29C so that the sheeting sections 39 and 43 are overlapped. Accordingly, the novel overlapping slot construction insures that all four sheeting sections in the frame will be automatically overlapped as they are driven into the earth.

The spreader members 22 and 23 may be formed by any structure providing the required structural strength. As illustrated, the front spreader member 22 comprises a rectangular frame which is secured to bent plates or angles 46 which are welded to the end plates 28 of each wall member. The spreader frame is formed by horizontal beam members 47, vertical column members 48 and end column members 49. A plate 50 is welded to the members 47, 48 and 49 to provide a structurally strong assembly which will handle the lateral forces exerted by the walls of the trench on the sheeting sections and ultimately by the sheeting installation frame itself. The front spreader member 22 is removably connected by nuts and bolts 51 to the angle plates 46 so that spreader members of different lengths may be employed for trenches of different widths. The rear spreader member 23 may be constructed in the same fashion as the front spreader member or a simplified construction of a lesser structural strength may be employed if desired. A simplified construction for the rear spreader member is possible because the rear spreader member is only called upon to handle the lateral thrust exerted by the walls of the trench on the sheeting sections while the front spreader member is very often used to drag the sheeting installation frame through a partially completed trench or along the surface of the ground. Since the dragging force exerted on the front spreader is normal to the plane of the spreader, a structurally stronger assembly is required. It will be noted that the end plates 28 and 32 which form the ends of the wall members are shown as planar or non-stepped plates. It is apparent, however, that these plates could be replaced by stepped end plates if desired so that all of the end plates in a wall member would comprise stepped plates. In this case, the angle members 46 would be welded to the laterally-extending edge portions of the stepped plates forming the ends of the wall members.

Figure 7:
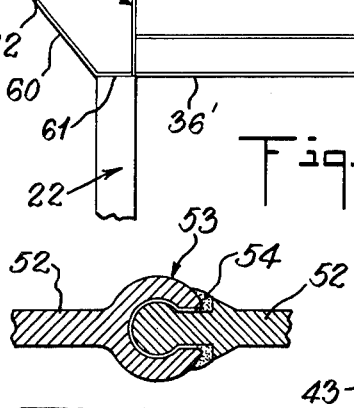
FIG. 7 is an enlarged sectional view of one of the joints which join segments of sheeting into sheeting sections for use with the installation frame of the invention.

In practice, the previously described component parts of the sheeting installation frame may be fabricated from a high strength steel and the steel plate utilized may be of one quarter inch thickness, for example. By welding all of the parts together, except for the connections between the front and rear spreaders and the wall members, a rigid, mechanically-rugged structure is assured. The sheeting sections 39 and 40 are commercially available and are usually made of a high strength steel sheet or plate. As seen in FIGS. 3 and 7 of the drawings, the sheeting sections are made up of long, narrow strips or segments 52 which are joined by vertically-extending tongue and groove connections 53. The segments 52 of sheeting may be welded together at 54 as shown in FIG. 7 to form unitary sheeting sections of the desired size. The sheeting sections may be provided with one or more horizontally-disposed rows of apertures 55 at spaced points along the length thereof as seen in FIG. 1. These apertures are adapted to receive removable locking pins 56 as shown in FIG. 5 of the drawings. When the locking pins 56 are inserted into a particular row of the apertures 55, the pins bear against the top 25 of the sheeting support members and limit the length of the sheeting sections which may be inserted into the sheeting support slots 24. By suitably spacing the height of one of the rows of apertures in relation to the height of the frame, the lower edge 57 of the sheeting sections may be prevented from extending beyond the bottom 26 of each wall member, so that the sheeting sections may be left in the slots in the frame when the frame itself is being dragged along the surface of the ground or being lifted by suitable lifting equipment to a new location along the proposed trench. This feature of the invention saves substantial amounts of time and labor since the sheeting sections need not be individually removed, handled and transported to the next section of the trench under construction as is necessary with the prior art methods.

Figure 8:
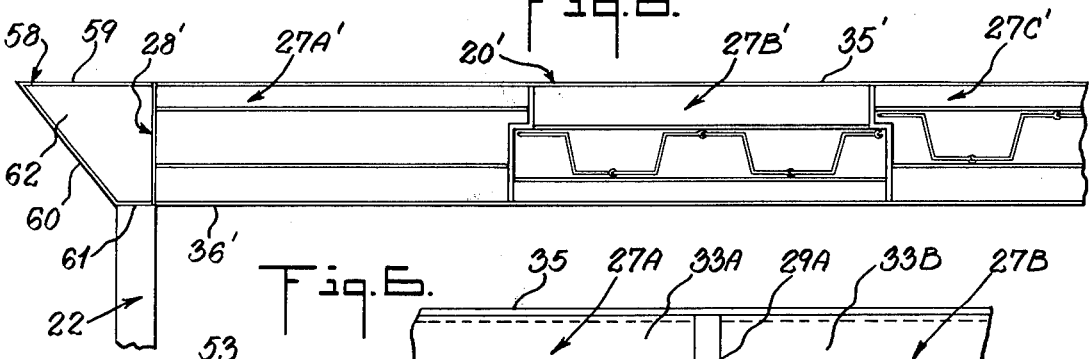
FIG. 8 is a fragmentary plan view of a modified form of sheeting support wall member having a front cutting edge.

In situations where subsurface ground conditions permit the sheeting installation frame to be dragged through the trench, front cutting edges 58 may be provided on the front ends of the wall members as shown in FIG. 8 of the drawings to shear off any projections or outcroppings of earth and stone along the side walls of the trench to further save construction time. Reference numerals with a prime notation are employed in FIG. 8 to designate parts which are the same as the correspondingly numbered parts in FIGS. 1 through 6. The vertically-disposed cutting edge 58 is formed on the front end plate 28′ of each wall member by a built-up plate section comprising plates 59, 60 and 61. Horizontally-disposed top and bottom plates 62 are respectively welded to the upper and lower edges of the plates 59, 60 and 61 to form a strong rigid structure.

It may be noted that the top 25 of each of the wall members is, except for the sheeting support slots 24, completely enclosed to prevent the accumulation of dirt and debris in the frame itself. The solid upper surface also provides a structurally sound bearing surface which may be employed to hammer the frame into position in a partially excavated trench. The sheeting installation frame can be made to accomodate virtually every type of commercially-available sheeting since the spacing between the cover plates 37 and 38 in each modular section may be readily changed to accomodate the particular type of sheeting employed. For example, the sheeting support slots could be made narrower if the sheeting sections employed were flat sheets or had smaller corrugations. In practice, it has been found that a clearance of about one quarter of an inch is satisfactory to permit the sheeting to be inserted and withdrawn from the slots. Regardless of the type of sheeting employed, however, the installation system of the invention permits the sheeting sections to be overlapped during installation.

Figure 9:
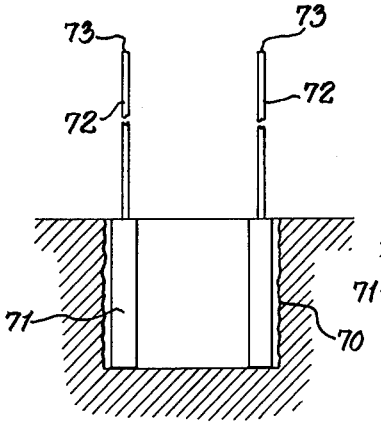
FIGS. 9, 10 and 11 are schematic sectional views showing the steps involved in the use of the sheeting installation system of the invention.
Figure 10:
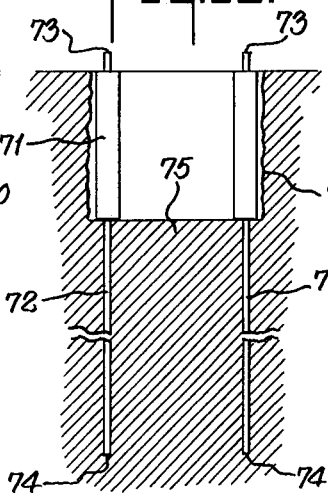
Figure 11:
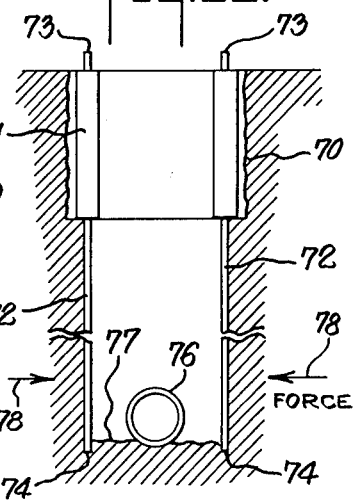

The method of using the sheeting installation system of the invention is shown in FIGS. 9, 10 and 11 of the drawings. As seen in FIG. 9, a shallow trench 70 is dug having a depth which is approximately equal to the height of the sheeting installation frame 71 and a width which is suitable to receive the frame. The installation frame 71 is then lowered into the trench and the sheeting sections 72 are inserted into the sheeting support slots. Next, the sections 72 of sheeting are hammered or driven down into the earth by a pile driver or other suitable equipment until the top edges 73 of the sheeting project a small distance above the top of the frame 71 and the bottom edges 74 of the sheeting are slightly below the desired elevation of the floor of the proposed trench as illustraed in FIG. 10 of the drawings. Following this, a back hoe or other excavation equipment is utilized to remove the earth 75 which is below the bottom of the installation frame and between the extended sections 72 of sheeting until the desired trench depth is reached. As seen in FIG. 11 the pipe 76 which is to be installed is then placed on the floor 77 of the trench by the workmen for the project.

At this time, the lateral force exerted by the earth walls of the trench on the portion of the sheeting 72 extending below the bottom of the installation frame is perpendicular to the plane of the sheeting sections as shown by the arrows 78 in FIG. 11 of the drawings. Since each section of sheeting is supported for a portion of its length by the support slots 24 of the installation frame and since the force is exerted on the portion of the sheeting which extends below the frame, a torque will be exerted on the sheeting to attempt to rotate it about the fulcrum formed by the bottom edge of the support slots 24. For example, in FIG. 11 the force exerted by the right side of the trench would tend to rotate the adjacent sheeting in a clockwise direction while the force exerted by the opposite wall of the trench on its adjacent sheeting would tend to rotate the other section of sheeting in a counterclockwise direction. Since the top portion of each section of sheeting can move only a short distance before it bears against the top edge of the sheeting support slot, the sections of sheeting are prevented from rotating and are, in effect, supported as a cantilever by the restraining force exerted by the frame against the portion of the sheeting inserted into the slots. By virtue of this arrangement, it is unnecessary to utilize additional supporting assemblies of any kind for the portions of the sheeting which extend below the sheeting installation frame of the invention. Since the support slots in the frame are overlapped, the sheeting section will also be overlapped after they are driven into place.

After the pipe 76 has been laid, the sheeting sections 72 are drawn upward in small increments of distance and the earth is filled back into the trench. If the sheeting were to be completely withdrawn in a single movement, the possibility exists that the earth walls might collapse and move the pipe 76 out of its desired alignment. Accordingly, the withdrawal of the sheeting is made in predetermined increments and the earth filled back into the trench as the sheeting is raised. If compacting is required, the earth may be compressed with compacting machines after the desired amount of withdrawal. When a section of the trench approximately equal to the length of the sheeting installation frame has been completed, the frame may be lifted out of the trench by a crane or other lifting device and placed in the next section to be dug or, if desired, the frame may be dragged or pulled through the partially excavated trench to the next section by a back hoe or other suitable equipment. In the latter event, the front cutting edges previously described serve to facilitate such dragging. The apertures and locking pins will then serve to maintain the sheeting in its retracted position in the support slots when the frame is being dragged or lifted.

The height of the wall members 20 and 21 for a given steel strength for the sheeting will be dependent upon the length of the sheeting sections employed because of the aforementioned cantilever support action which requires that a suitable length of the sheeting section be disposed within the slot. For exmaple, for a sheeting section having a 25 foot length and with a high strength grade of sheet steel employed for the sheeting sections, the installation frame may be approximately 5 feet high. A suitable length for the installation frame which may be easily handled by most equipment has been found to be about 20 feet long.

It is believed apparent that many changes could be made in the construction and described uses of the foregoing sheeting installation system and many seemingly different embodiments of the invention could be constructed without departing from the scope thereof. For example, the large outer cover plates 35 and 36 of each wall member could be replaced by a series of smaller cover plates having a length equal to the length of each modular section as illustrated and described in the aforementioned patent application, Ser. No. 566,079. Accordingly, it is intended that all matter contained in the above description or shown in the accompanying drawings shall be interpreted as illustrative and not in a limiting sense.

What is claimed is:

1. A sheeting installation frame for installing sheeting sections during trench excavations and the like comprising a pair of sheeting support wall members, each of said wall members having at least two substantially vertically-disposed sheeting support slots extending therethrough for slidably supporting sheeting sections therein with cantilever support, the sheeting support slots of each of said wall members being located along the length of the wall member and disposed in modular sections of the wall member defined by a series of substantially vertically-disposed and spaced apart end plates having laterally-extending edge portions, the end plates between abutting modular sections being stepped plates having longitudinally-extending central portions joining the edge portions thereof to separate the support slots of the abutting modular sections, so that the support slots of abutting modular sections are disposed on opposite sides of the end plate central portions in overlapping relationship, whereby sheeting sections disposed in said slots are overlapped;

a pair of spreader members disposed between said wall members adjacent opposite ends thereof for separating said wall member slots the distance between sheeting sections to be installed on opposite trench sides; and means for removably connecting said spreader members to said wall members to form a frame which resists the lateral forces exerted by said trench sides on the sheeting sections in said slots.

2. A sheeting installation frame as claimed in claim 1 wherein each of said sheeting support wall members has one end thereof tapered to form a substantially vertically-disposed cutting edge, whereby the pair of cutting edges so formed is adapted to function as side cutters to widen a trench as the installation frame is dragged therealong.

3. A sheeting installation frame as claimed in claim 1 further comprising means for locking the sheeting sections in retracted position within said sheeting support slots, said locking means comprising a plurality of rows of horizontally-disposed apertures in each of the sheeting sections at spaced points along the length thereof, and removable locking pins inserted in said apertures.

4. A sheeting installation frame as claimed in claim 1 wherein each of said modular sections comprises first and second spaced apart rows of substantially horizontally-disposed support beams interconnecting the corresponding edge portions of the end plates defining the modular section, and cover plates mounted on opposite sides of each of said rows of support beams and extending between the end plates defining the modular section, so that the sheeting support slot for each modular section has closed walls defined by the inwardly facing cover plates in the space between said rows of support beams and the central and edge portions of the end plates defining the modular section.

5. A sheeting installation frame as claimed in claim 4 wherein the end plates at the ends of each wall member are substantially planar plates.

6. A sheeting installation frame as claimed in claim 4 wherein each of said wall members comprises at least three of said modular sections, and the stepped end plates defining the center modular section face in opposite directions, so that the sheeting support slot in said center modular section is disposed on one side of the central portions of the stepped end plates defining that section and the support slots of the abutting modular sections are disposed on the other side of the stepped plate central portions.

7. A sheeting installation frame as claimed in claim 4 wherein the sheeting sections have substantially vertically-disposed corrugations formed therein.

8. A sheeting installation frame as claimed in claim 7 wherein the height of each of said wall members is approximately one fifth of the length of the sheeting sections.

9. A sheeting installation system for installing sheeting sections of the corrugated sheet type during trench excavations and the like comprising a pair of substantially rectangular sheeting support wall members, each of said wall members having a plurality of modular sections defined by a series of substantially vertically-disposed and spaced apart end plates having substantially parallel laterally-extending edge portions, the end plates between abutting modular sections being stepped plates having longitudinally-extending central portions joining the edge portions thereof, and cover plates extending between the edge portions of the end plates defining each modular section to form a substantially vertically-disposed sheeting support slot having closed walls in each modular section, a portion of the closed walls of each support slot being formed by the central portions of said stepped end plates so that the support slots of abutting modular sections are disposed on opposite sides of the central portion of the end plate between such abutting modular sections and are overlapped;

a pair of spreader members removably connected between said wall members adjacent opposite ends thereof to form a substantially rectangular sheeting installation frame;

sheeting sections disposed in said support slots, each of said sheeting sections having substantially vertically-disposed corrugations formed therein; and adjustable locking means for locking said sheeting sections in a plurality of extended positions with respect to said support slots.

* * * * *